United States Patent [19]

Hashimoto

[11] 3,971,615

[45] July 27, 1976

[54] SERIES CONNECTOR

[76] Inventor: Syunichi Hashimoto, 36-24, Higashiryoke 2-chome, Kawaguchi, Saitama, Japan

[22] Filed: Apr. 3, 1975

[21] Appl. No.: 564,708

[30] Foreign Application Priority Data

July 30, 1974 Japan ..... 49-90112
June 11, 1974 Japan ..... 49-66950

[52] U.S. Cl. ..... 339/98
[51] Int. Cl.[2] ..... H01R 9/08
[58] Field of Search ..... 339/95, 97–99

[56] References Cited

UNITED STATES PATENTS

| | | | |
|---|---|---|---|
| 3,836,944 | 9/1974 | Lawson | 339/99 R |
| 3,890,029 | 6/1975 | Izraeli | 339/98 |

FOREIGN PATENTS OR APPLICATIONS

| | | | |
|---|---|---|---|
| 544,048 | 1/1956 | Belgium | 339/99 R |

*Primary Examiner*—Joseph H. McGlynn
*Attorney, Agent, or Firm*—Ostrolenk, Faber, Gerb & Soffen

[57] ABSTRACT

A connector for forming a series electrical connection between opposing ends of a pair of insulation-covered wires comprises a lower body portion having a longitudinal groove and a pair of upper body portions connected to and superimposable upon the lower body portion. Each of the upper body portions has a longitudinal groove for receiving and maintaining one wire end within the groove in the lower body portion. Each of the upper and lower body portions contain formations for receiving a conductive connecting piece having a pair of opposed blade portions for piercing the insulation to contact each wire end for forming a series connection. Opposing ends of the groove in the lower body portion and the outer ends of the groove in each upper body portion are formed with a thin yieldable wall for resiliently holding each wire end. Complementary means are attached to each body portion for mechanically fastening each upper body portion to the lower body portion to positively maintain proper electrical connection between the opposed wire ends.

2 Claims, 11 Drawing Figures

SERIES CONNECTOR

BACKGROUND OF THE INVENTION

This invention relates to a series connector for electrically connecting the opposite ends of a single covered wire or the opposite ends of a plurality of covered wires linearly and more particularly, to a series connector in which the upper body may be divided into two separate parts so that the upper body portion can be positively and easily connected to the lower body portion.

There have been proposed and practically employed a great variety of electrical connectors and one of the prior art electrical connectors employs a pair of opposite slitted connecting means whereby the slitted portions of the connecting means thrust into the opposite sides of the opposite ends of a covered wire to be connected to electrically connect the wire ends together, but the prior art connector frequently fails to connect the wire ends satisfactorily which results in frequent breaking down of the wire.

SUMMARY OF THE INVENTION

Therefore, one principal object of the present invention is to provide a series connector which can effectively eliminate the disadvantage inherent in the prior art electrical connector referred to hereinabove.

Another object of the present invention is to provide a series connector which employs a connecting piece having two opposed and spaced substantially U-shaped hook portions each provided with a pointed thrusting blade positioned between the opposite legs of the U-shaped portions whereby the pointed blades thrust into the opposed ends of a pair of insulation-covered wires to be connected together so as to positively hold the wire ends in their electrically connected condition and at the same time, to minimize breakage of the wires.

Another object of the present invention is to provide a series connector which employs a plurality of connecting pieces each having two opposite and spaced substantially U-shaped hook pieces each provided with a pointed thrusting blade positioned between the opposite legs of the U-shaped portions whereby the pointed blades thrust into the opposed ends of a pair of insulation-covered wires to be connected together so as to positively hold the wire ends in their connected condition and at the same time, to minimize breakage of the wires.

Another object of the present invention is to provide a series connector in which a lower body portion is provided with a single longitudinal groove which has a pair of opposed wire engaging portions positioned midway between the opposite ends thereof and thin yieldable end walls at the opposite ends thereof which end walls serve as packing means to prevent the wire ends from being displaced and/or dust and other foreign matters from entering the grooves in cooperation with the similar thin yieldable outer end walls of a pair of upper body portions.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

Figure 1:
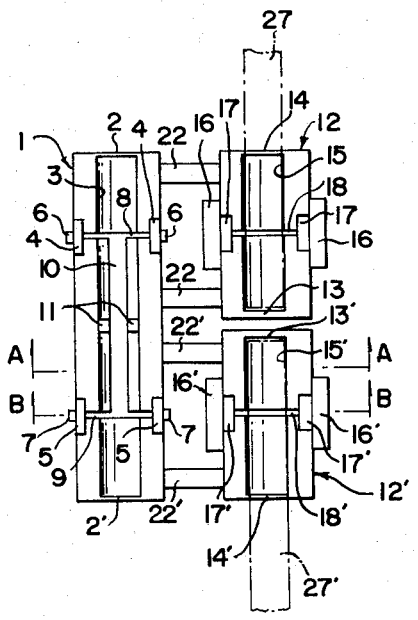
FIG. 1 is a developed plan view of a first enbodiment of series connector constructed in accordance with the present invention prior to assembly of the same.
Figure 3:
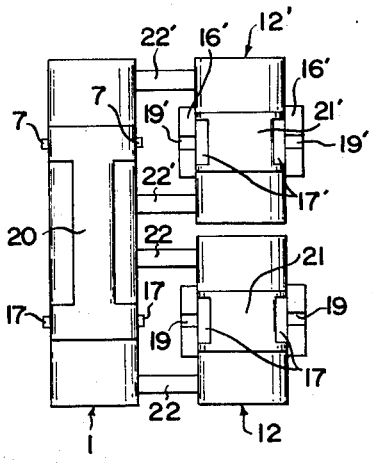
FIG. 3 is a bottom plan view of FIG. 1.
Figure 2:
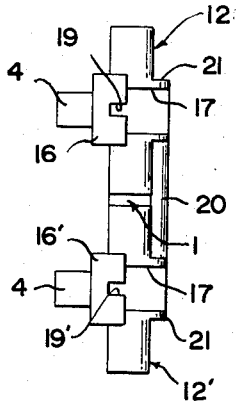
FIG. 2 is a side view of said series connector as seen from the right-hand side of FIG. 1.
Figure 4:
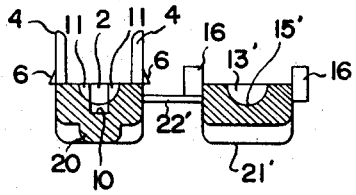
FIG. 4 is a cross-sectional view taken substantially along the line A — A of FIG. 1.
Figure 5:
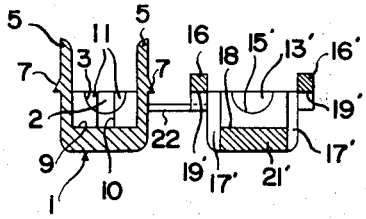
FIG. 5 is a cross-sectional view taken substantially along the line B — B of FIG. 1.

The present invention will be now described referring to the accompanying drawings and more particularly, to FIGS. 1 through 6 thereof which show the first embodiment of series connector constructed in acordance with the principle of the present invention. The series connector generally comprises an integral main body which has been formed by molding a hard insulating synthetic resin and includes a rectangular lower body portion 1 and and upper body unit comprising a pair of opposed rectangular upper body portions 12 and 12' which complement each other in the manner as will be described in detail hereinafter. The terms "lower body portion" and "upper body portions" employed herein are based on the positions of these body portions when they are assembled into a complete series connector.

The lower body portion 1 is formed in one major surface (which faces the upper body portions 12 and 12' when the body portions are assembled) with a longitudinal center groove 3 which extends along the length of the body portion for a substantial distance and terminates short of the opposite ends of the associated body portion to thereby leave a pair of thin end walls 2, 2' at the opposite ends of the lower body portion. The center groove 3 has a semi-circular cross-section. The lower body portion 1 is also formed adjacent to and inwardly of the opposite sides of the above-mentioned major surface with a first pair of engaging projections 4, 4 extending uprightly from the major surface adjacent to one end of the body portion and a second pair of similar engaging projections 5, 5 extending uprightly from the major surface adjacent to the other end of the body portion. The first pair of engaging projections 4, 4 have on their outer surfaces projections 6, 6 which project laterally from the associated engaging projections and similarly, the second pair of engaging projections 5, 5 have on their outer surfaces projections 7, 7 which project laterally from the associated engaging projections. The above-mentioned major surface of the lower body portion 1 is further formed with transverse grooves 8 and 9 extending between the first pair of engaging projections 4, 4 and the second pair of engaging projections 5, 5, respectively and intersecting the center groove 3 at right angles thereto. The bottom of the center groove 3 has a flat-bottomed recess 10 which is positioned in the center of the groove 3 and extends between the transverse grooves 8 and 9 and a pair of engaging pieces 11, 11 are formed on the opposite sides of the flat-bottomed recess 10 midway between the opposite ends of the recess 10.

Figure 6:
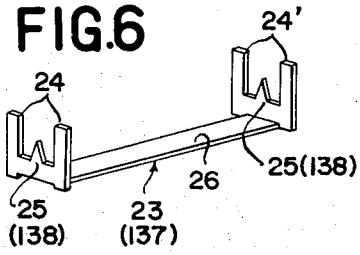
FIG. 6 is a perspective view of the connecting piece employed in the series connector as shown in FIG. 1.

One of the upper body portions 12 is formed in the major surface, which faces the lower body portion 1 when the upper body portion is superimposed upon the lower body portion 1, with a longitudinal center groove 15 which extends along the length of the associated body portion for a substantial distance and terminates short of the opposite ends of the body portion to thereby form a pair of end walls 13 and 14 at the opposite ends of the upper body portion 12. The end wall 14 is thinner than the end wall 13 and is easily yieldable for the purpose to be described hereinafter. The center groove 15 has a semi-circular cross-section which corresponds to the semi-circular cross-section configuration of the longitudinal groove 3 in the lower body portion 1. The upper body portion 12 is further formed with a pair of engaging ears 16, 16 in a midway between the opposite ends of the associated body portion and along opposite sides thereof, which ears project uprightly from the major surface. A pair of opposed recesses 17, 17 are formed in the above-mentioned major surface of the upper body portion 12 in positions adjacent to and inwardly spaced from the respectively associated engaging ears 16, 16 and the recesses 17, 17 are adapted to receive the engaging projections 4, 4 of the lower body portion 1. The above-mentioned major surface of the upper body portion 12 is further formed with a transverse groove 18 which extends between the recesses 17, 17 and intersects the longitudinal groove 15 at right angles thereto. Similarly, the other upper body portion 12' is formed in one major surface, which faces the lower body portion 1 when the upper body portion is superimposed upon the lower body portion, with a longitudinal center groove 15' which extends along the length of the associated body porton for a substantial distance and terminates short of the opposite ends of the body porton to thereby form a pair of end walls 13', 14' at the opposite ends of the upper body portion 12'. The end wall 14' is thinner than the end wall 13' and is easily yieldable for the purpose to be described hereinafter. The center groove 15' also has a semi-circular cross-section configuration. The thicker end wall 13' of the second upper body porton 12' is spaced from the corresponding end wall 13 of the first upper body porton 12 by the distance corresponding to the length of the engaging pieces 11, 11 as measured in the longitudinal direction of the lower body portion 1. The upper body portion 12' is further formed with a pair of engaging ears 16', 16' on the opposite sides thereof midway between the opposite ends of the associated body portion which ears project uprightly from the above-mentioned major surface. A pair of opposed recesses 17', 17' are formed in the above-mentioned major surface of the upper body portion 12' in positions adjacent to and inwardly from the respectively associated engaging ears 16', 16' and the recesses 17', 17' are adapted to receive the engaging projections 5, 5 of the lower body portion 1. The above-mentioned major surface of the upper body portion 12' is further formed with a transverse groove 18' which extends between the recesses 17', 17' and perpendicularly intersects the longitudinal groove 15'. The transverse recesses 8 and 9 align with the transverse grooves 18 and 18' in the lower body portion 1, respectively, which the upper body portions 12, 12' are superimposed upon the lower body portion 1. In order to reinforce the transverse grooves 8, 9 and center recess 10 in the lower body portion 1 and the transverse grooves 18, 18' in the upper body portions 12, 12', respectively, the lower body portion 1 is increased in thickness in a suitably selected position along and opposite to the bottom of the center recess and the upper body portions 12, 12' are also increased in thickness in suitably selected positions along and opposite to the bottoms of the center grooves 15, 15', respectively. The lower body portion 1 and pair of upper body portions 12, 12' are connected together at their one side edge by means of a plurality of spaced thin flexible connection strips 22, 22 and 22', 22'. The side of the first and second pairs of engaging ears 16 and 16' which directs the other major face of the associated upper body portion 12 is provided with notches 19 and 19', respectively, for receiving the lateral projections 6, 6 of the lower body portion 1. In FIG. 6, reference numeral 23 denotes a connecting piece formed of a conductive material and the connecting piece includes a pair of spaced substantially U-shaped hook portions 24 and 24' which are connected together in a spaced relationship by means of a connecting strip 26 which extends between and is integrally connected to the foot portions of the hook portions. Each of the U-shaped hook portions 24 and 24' is formed with a pointed thrusting blade 25 which is positioned between the opposite legs and extends uprightly from the foot portion of the associated hook portion for the purpose to be described hereinafter. In assembling, the connecting piece 23 is held in position on the lower body portion 1 by inserting the connecting strap 26 into the center recess 10 and the feet of the hook portions 24, 24' into the transverse grooves 8 and 9, respectively, with the legs and pointed thrusting blades 25, 25 directed upwardly. Then, covered wires 27 and 27' are inserted into the center groove 3 in the lower body portion 1 from the opposite ends of the center groove 3 by hand or any suitable tool until the inner ends of covered wires 27, 27' abut against each other and held in position by the opposite engaging pieces 11, 11. In this position, the covered wires 27, 27' are positioned between the legs of the spaced hook portions 24, 24' of the connecting piece 23. Alternatively, the covered wires 27, 27' may be received in the center grooves 15 and 15' in the upper body portions 12 and 12' within the scope of the invention. It should be noted that since the end walls 2 and 2' which define the opposite ends of the center groove 3 are very thin and yieldable so that the end walls yield easily subjected to the force which will be applied on the covered wires 27, 27' when they are inserted into the center groove 3 in the lower body portion 1, the end walls will not resist the insertion of the covered wires and after the wires have been properly positioned in the lower body portion 1, the end walls resiliently hold the covered wires in position by their resiliency cooperation with the engaging pieces 11, 11, the corresponding end walls 13, 14 and 13', 14' of the upper body portions 12, 12' and the connecting piece 23 as will be apparent hereinafter Thereafter, the connecting strips 22, 22 and 22', 22' are bent so as to superimpose the upper body portions 12, 12' upon the lower body portion 1 until the first and second pairs of upright engaging projections 4, 4 and 5, 5 of the lower body portion 1 are received in the mating recesses 17, 17 and 17', 17', respectively.

When the lower and upper body portions 1 and 12, 12' are assembled together in the manner mentioned hereinabove after the covered wires 27 and 27' have been inserted in the center groove 3 in the lower body portion 1, the thin and flexible end walls 2, 2' and 14, 14' yield resiliently to snugly fit on the covered wires 27, 27' to thereby form packings between the covered wires and center grooves 3 and 15, 15' in the lower and upper body portions 1 and 12, 12', respectively. At the same time, the pointed thrusting blades 25, 25 on the hook portions 24, 24' of the connecting piece 23 thrust into the covered wires 27, 27' by their pointed tips to firmly hold the wires. Thus, the aligned covered wires 27, 27' can be electrically connected to the connecting strip 26 through the thrusting blades 25, 25.

Furthermore, once the lower and upper body portions 1 and 12, 12' are assembled together in the manner as mentioned hereinabove, the first and second pairs of engaging projections 4, 4 and 5, 5 are effectively prevented from coming out of their respectively associated recesses 6, 6 and 7, 7 because the projections 6, 6 and 7, 7 engage in their respectively associated notches 19, 19'.

Now referring to FIGS. 7 through 11 in which the second embodiment of series connector constructed in accordance with the present invention is shown, the series connector generally comprises an integral main body which has been formed by molding a hard insulating synthetic resin and includes a rectangular lower body portion 101 and an upper body unit comprising a pair of rectangular upper body portions 11 which complement each other in the manner as will be described hereinafter in detail. Also in the second embodiment, the terms "lower body portion" and "upper body portions" employed herein are based on the positions of these body portions when they are assembled together into a complete series connector. The lower and upper body portions 101 and 114, 114 are connected to each other by means of thin flexible connecting strips 115, 115 and 126, 126, respectively at their one side edge as in the case of the first embodiment.

One major surface of the lower body portion 101 which faces the upper body portions 114 when these body portions are assembled together is formed with a plurality of laterally spaced and parallel grooves 102 which extend for a substantial distance along the length of the lower body portion 101 and terminate short of the opposite ends of the associated body portion to thereby form thin yieldable end walls 112 and 113 at the opposite ends of the body portion which define the end walls of the respectively associated grooves 102. The adjacent grooves 102 are separated from each other by lands 103. As in the case of the first embodiment of series connector, the grooves 102 have a semicircular cross-section. First and second pairs of engaging ears 104, 104 and 105, 105 are formed on opposed sides of the lower body portion 101 adjacent to the opposite ends of the lower body portion and these engaging ears extend uprightly from the above-mentioned major surface. The first and second pairs of engaging ears 104, 104 and 105, 105 have projections 106, 106 and 107, 107 which extend laterally and outwardly from the associated engaging pieces, respectively. Engaging projections 110 are provided on the lands 103 of the above-mentioned major surface of the lower body portion 101 projecting uprightly from the associated lands and positioned between the adjacent grooves 102 in parallel to the engaging ears 104. Similarly, engaging projections 111 are provided on the lands of the same major surface of the lower body portion projecting uprightly from the associated lands and positioned between the adjacent grooves 102 in parallel to the engaging ear 105. Transverse grooves 108 extend across the respectively associated grooves 102 at right angles thereto between the engaging ears 104 and engaging projections 110 and between adjacent engaging projections 110, respectively. Similarly, transverse grooves 108' extend across the respectively associated grooves 102 at right angles thereto between the engaging ears 105 and engaging projections 111 and between adjacent engaging projections 111, respectively. The bottom of each of the longitudinal grooves 102 is formed in the center thereof with a longitudinal recess 109 which connects between the transverse grooves 108 and 108' which intersect the associated longitudinal groove 102. A pair of engaging pieces 139 are formed on opposed sides of each of the recess 109 midway between the opposite ends of the associated recess and the length of the lands 139 (as seen in the longitudinal direction of the lower body portion) corresponds to the width of the space defined between the opposite sides of the pair of upper body portions 114 and 125, which space is provided when the upper body portions are superimposed upon the lower body portion 1. The space between each pair of the engaging pieces 139 is substantially equal to or slightly greater than the width of the recess 109. A plurality of engaging projections 135 are provided spaced from the opposite ends of the engaging projections 110 positioned on the two inner adjacent partition lands 103 and the engaging projections 135 have a length shorter than that of the engaging projections 110 (as seen in the longitudinal direction of the associated partition land 103). Similarly, a plurality of shorter engaging projections 135' are provided spaced from the opposite ends of the longer engaging projections 111 positioned on the two inner lands 103.

One of the upper body portions 114 which is adapted to cover substantially one-half of the lower body portion 101 is formed in one major surface which faces the lower body portion 101 when the upper body portion is superimposed upon the lower body portion with a plurality of laterally spaced grooves 117 of a semi-circular cross-section which extend along the width of the upper body portion 114 and terminate short of the opposite sides of the associated upper body portion 114 to thereby define at the opposite sides of the body portion end walls 118 and 119 which define the opposite ends of the grooves 117. The grooves 117 are separated from each other by means of a plurality of partition lands 116. The positions and widths of the grooves 117 and partition lands 116 are so selected that when the upper body portion 117 superimposed upon the lower body portion 101, the grooves and partition lands are aligned with the grooves and partition lands of the lower body portion 101, respectively. The end walls 119 are thinner than the other ends walls 118 and are yieldable for the purpose to be described hereinafter. A pair of engaging ears 120, 120 are formed on the opposite ends of the upper body portion projecting uprightly from the above-mentioned major surface of the upper body portion 114. A pair of recesses 121, 121 are formed in the above-mentioned major surface of the upper body portion ajdacent to and inwardly of the engaging ears 120, 120 for receiving the engaging projections 104, 104 on the lower body portion 101. Transverse grooves 122 extend across the grooves 117 at right angles thereto and the recesses 121. The side of the engaging ears 120, 120 which faces the other major surface of the upper body portion 114 is formed with notches 123 for receiving the engaging projections 106, 106 of the lower body portion 101. A plurality of recesses 124 are formed in the lands 116 for receiving the longer engaging projections 110 which are positioned parallel to the engaging projections 104, 104 and similarly, a plurality of recesses 124′ are formed in the lands 116 for receiving the shorter engaging projections 135, 135.

The other upper body portion 125 which is adapted to cover substantially the remaining one-half of the lower body portion 101 is formed in one major surface which faces the lower body portion when the upper body portion is superimposed upon the lower body portion 101 with a plurality of laterally spaced grooves 128 which extend along the width of the associated upper body and terminate short of the opposite sides of the body portion to thereby define opposed thicker and thinner end walls 129 and 130 which define the opposite ends of the grooves 128. The grooves 128 are separated from each other by a plurality of partition lands 127 and the end walls 130 are thinner than the end walls 129 and are yieldable for the purpose to be described hereinafter. The grooves 128 also have a semicircular cross-section. A pair of engaging ears 131 and 131 are formed on the outer surfaces of the opposite end of the upper body portion 125 which project uprightly from the above-mentioned major surface and a pair of recesses 134, 134 are formed in the above-mentioned major surface of the upper body portion adjacent to and inwardly of the projections 131, 131 for receiving the engaging projections 105 of the lower body portion 101. Transverse grooves 133 extend across the grooves 128 at right angles thereto. The positions and widths of the grooves 128 and lands 127 are so selected that when the upper body portion 125 is superimposed upon the remaining one-half of the lower body portion 101, the grooves 128 and lands 127 are aligned with the corresponding parts of the lower body portion 101, respectively. The side of the engaging ears 134, 134 which faces the other major surface of the associated upper body portion 125 is formed with notches 137, 137 for receiving the engaging projections 107, 107 on the lower body portion 101. Longer recesses 132 are formed in the lands 127, 127 of the associated upper body portion 125 between the transverse grooves 133 at right angles thereto and a pair of shorter recesses 132′ are positioned spaced from the opposite ends of the longer recess 132 and positioned between the two inner grooves 128, 128 for receiving the engaging projections 111, 111 and 135′, 135, respectively. Reference numeral 137 (FIG. 6) denotes a connecting strip which is substantially similar to the connecting strip 26, as described in connection with the first embodiment of series connector and includes a pair of substantially U-shaped hook portions 138 and 138 whose feet are connected to the opposite ends of the connecting strip and which have pointed thrusting blades 138, 138 positioned between the opposed legs of the hook portions (see FIG. 6). In assembling, the connecting strip is positioned in the lower body portion by inserting the connecting strip into the associated longitudinal recess 109 and the hook portions 138 and 138 into the transverse grooves 108 and 108′. It is noted that the number of the connecting pieces 137 corresponds to the number of longitudinal recess and transverse groove assemblies 109, 108 and 108′.

Figure 7:
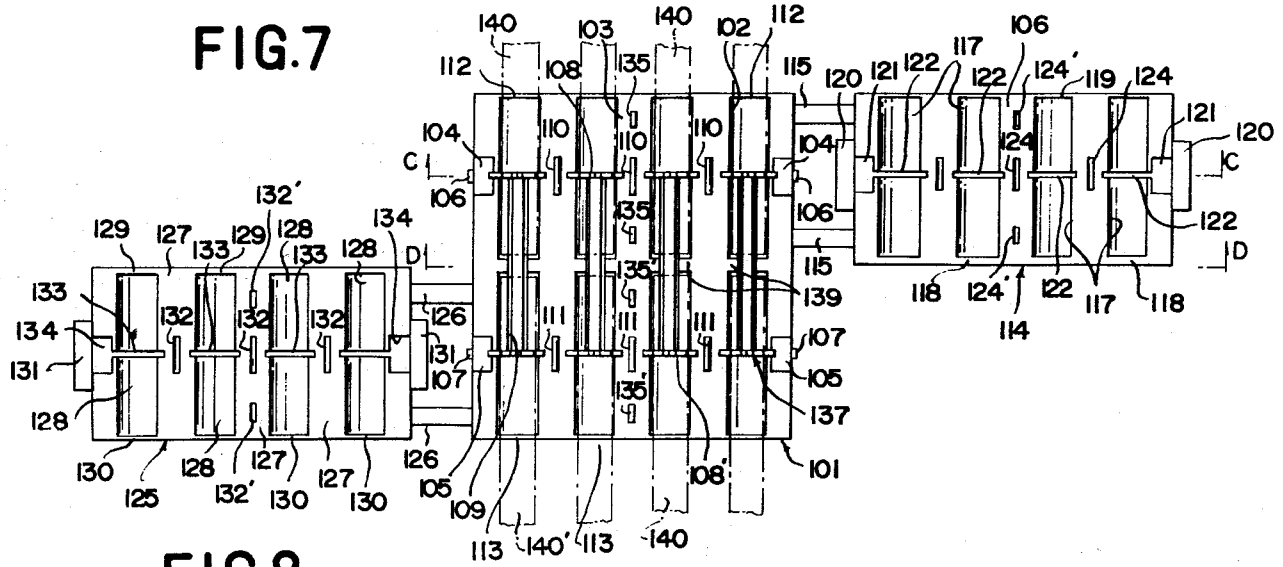
FIG. 7 is a developed plan view of a second embodiment of series connector constructed in accordance with the present invention prior to assembly of the same.
Figure 8:
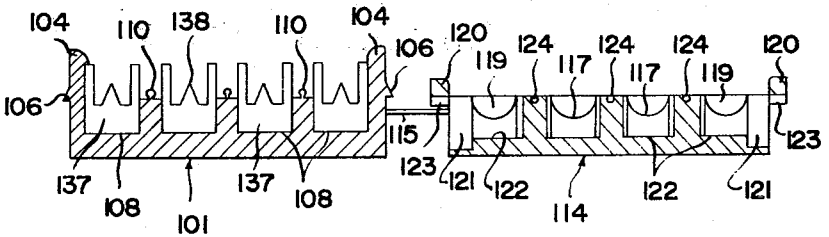
FIG. 8 is a cross-sectional view taken substantially along the line C — C of FIG. 7.
Figure 9:
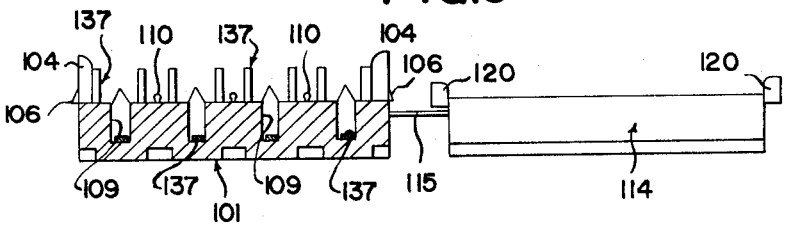
FIG. 9 is a cross-sectional view taken substantially along the line D — D of FIG. 7.
Figure 10:
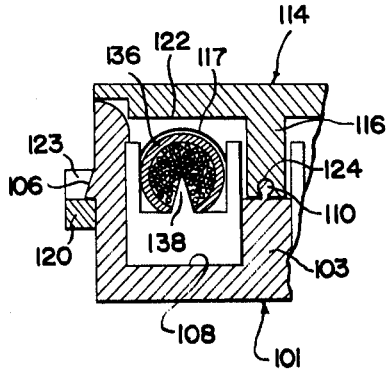
FIG. 10 is a partially cross-sectional view on an enlarged scale especially showing the electrical connection between one insulation-covered wire and the pointed blade of one of the connecting pieces as shown in FIG. 7 employed in the series connector.
Figure 11:
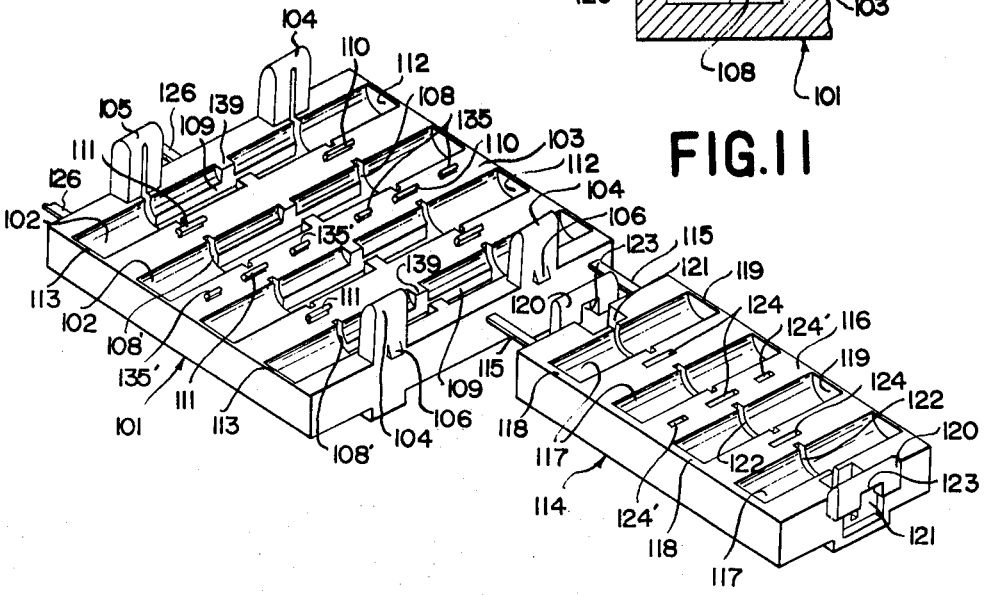
FIG. 11 is a perspective view of the series connector as shown in FIG. 7 with a portion thereof broken away in order to show some parts of the series connector more clearly.

In assembling, as shown in FIG. 7, a pair of covered wires 140 and 140′ are inserted into each of the longitudinal grooves 102 in the lower body portion 101 from the opposite ends of the associated longitudinal groove 102 until the inner ends of the covered wires abut against each other and engaged by the opposite engaging pieces 139 associated with the particular longitudinal groove 102. In this position, the covered wires 140 and 140′ engage the pointed thrusting blades 138, 138 of the connecting piece 137. Then, the connecting strips 115, 115 and 126, 126 are bent so as to superimpose the upper body portions 114 and 125 upon the lower body portion 101 whereupon the mating parts of the three body portions engage each other in the manner as described in connection with the first embodiment of series connector and the covered wires 140, 140′ are gripped by the longitudinal grooves 102 in the lower body portion 101 and the grooves 117, 117 and 128, 128 in the upper body portions 114 and 125. In the insertion of the covered wires 140 and 140′ into the grooves 102 and 117, 128 in the lower and upper body portions 114, 125, the thin end walls 112, 113 of the lower body portion 101 and the thin end walls 119 and 130 of the upper body portions 114, 125 yield easily under the insertion force applied on the covered wires so as to form packings between the covered wires and the grooves 102, 117 and 128 in the lower and upper body portions 101, 114 and 125 whereby the covered wires can be effectively prevented from displacing and dust and other foreign matters are prevented from invading into the grooves. When the covered wires 140, 140′ are received and held in position in the plurality of groove assemblies 101, 114 and 125, the wires are in series connected through the connecting pieces 137.

Although the two upper body portions 114 and 125 are shown as separate parts, the upper body portions may be formed into a unitary structure without departing from the spirit and scope of the present invention.

As clear from the foregoing description of the two preferred embodiments, according to the present invention, since the thrusting blades 25, 25 or 138, 138 of the connecting piece 23 or pieces 137 thrust into the covered wires 27, 27′ or 140, 140′ to electrically connect the covered wires in series and as desired or necessary, the upper body portion is formed by two separate parts each covering substantially one-half of the lower body portion, the upper body portions can be connected to the lower body portions one by one and the covered wires can be electrically connected together by bare hand without the use of any specific tool. Furthermore, since the thin end walls 2, 2′ and 14, 14′ or 112, 113 and 119, 130 in the lower and upper body portions 1, 12 and 12′ or 101, 114 and 125 are yieldable when subjected to the insertion force applied on the covered wires to form packing between the grooves in the lower and upper body portions and the wires whereby the covered wires and the opposite ends of the lower and upper body portions are effectively protected against possible damage and at the same time, dust and other foreign matter can be prevented from entering into the grooves in the body portions.

Even when a plurality of covered wires are positioned in parallel and electrically series connected to each other, since the lower and upper body portions are engaged to each other not only on their opposed side edges, but also in the center portions by means of the mating parts formed on the lands and in the grooves, respectively, the center portions of the lower and upper body portions are prevented from separating from each other to thereby satisfactorily maintain electrical connection between each series connected pair of the covered wires.

While only two embodiments of the invention have been shown and described in detail, it will be understood that the same are for illustration purpose only and not to be taken as a definition of the invention, reference being had for the purpose to the appended claims.

What is claimed is:

1. A series connector for electrically connecting the ends of a pair of wires, comprising a unitary main body formed of hard insulating synthetic resin and including:

1. a rectangular lower body portion which has in one major surface thereof a longitudinal center groove of semicircular cross-section extending for a substantial distance along the length of said body portion and terminating short of the opposite ends of the latter to thereby form a pair of thin yieldable end walls; a first pair of opposed engaging projections extending uprightly from said major surface adjacent to one end of said body portion, each upright projection having a projection extending laterally and outwardly of the associated upright engaging projection; a second pair of engaging projections extending uprightly from said major surface adjacent to the other end of said body portion, each upright projection having a projection extending laterally and outwardly of the associate upright projection; said lower body portion having first and second transverse grooves extending between said first and second pairs of upright projections, respectively, and intersecting said longitudinal center groove at right angles thereto, a longitudinal recess formed in the bottom of said longitudinal center groove and extending between said first and second transverse grooves; and a pair of opposite engaging pieces formed on the opposite sides of said longitudinal recess midway between the opposite ends thereof;
2. a pair of spaced upper body portions connected to said lower body portion and superimposed upon the lower body portion, each upper body portion having a pair of opposed engaging ears projecting upwardly from one major surface of the associated upper body portion on the opposite sides of the latter and provided with a pair of notches for cooperatively receiving the mating lateral and outward projections on the upright projections of said lower body portion; each upper body portion having a center longitudinal groove extending for a substantial distance along the length thereof and terminating short of the opposite ends of the associated upper body portion to thereby form a pair of end walls one of which is thin and yieldable; a pair of recesses provided adjacent to and inwardly of the respectively associated engaging ears for receiving said upright projections of the lower body portion; and a transverse groove extending between said recesses and intersecting said longitudinal groove in the associated upper body portion; and an electrically conductive connecting piece received in said longitudinal slot and said first and second transverse grooves in the lower body portion and in the cooperating transverse grooves in said upper body portions, said conductive connecting piece having a pointed thrusting blade at each of the opposite ends thereof to pierce and hold each respective wire end.

2. A series connector for electrically connecting a plurality of pairs of wire ends, comprising a unitary main body formed of hard insulating resin and including:

1. a rectangular lower body portion which has in one major surface thereof, a plurality of spaced, parallel longitudinal grooves of semi-circular cross-section extending for a substantial distance along the length of the body portion and terminating short of the opposite ends of the body portion to thereby form a pair of thin yieldable end walls; a first pair of opposed engaging projections extending uprightly from said major surface adjacent to one end of said body portion; each upright projection having a projection extending laterally and outwardly of the associated upright engaging projections; a second pair of engaging projections extending uprightly from said major surface, each of said second pair of projections having a projection extending laterally and outwardly of the associated upright projection; said lower body portion having transverse grooves extending between said first pair of upright projections and said second pair of upright projections, respectively, and intersecting said plurality of longitudinal grooves at right angles thereto, respectively, a longitudinal recess formed in the bottom of each of said longitudinal grooves and extending between the pair of longitudinally spaced transverse grooves associated with each of the longitudinal grooves; and a pair of opposite engaging pieces formed on the opposite sides of each of the longitudinal recesses midway between the opposite ends of the associated recess; and
2. a pair of upper body portions connected to said lower body portions and superimposed upon said lower body portion, each upper body portion having a pair of opposed engaging ears projecting uprightly from one major surface of the associated upper body and provided with a pair of notches for cooperatively receiving the mating lateral and outward projections on the upright projections of said lower body portion; a plurality of spaced and parallel grooves extending for a substantial distance along the width of the associated lower body portion and separated by a plurality of parallel spaced lands, each groove terminating short of the opposite ends of the associated lower body portion to thereby form end walls of different thicknesses one of which is yieldable; a pair of recesses provided adjacent to and inwardly of the associated engaging ears for receiving the associated upright projections of the lower body portion; and transverse grooves extending between said pair of engaging ears and intersecting said first-mentioned spaced grooves in the associated upper body portion and projections extending uprightly from said lands between said transverse grooves; and a plurality of electrically conductive connecting pieces each received in one of said longitudinal recesses and first and second transverse grooves in said lower body portion and in a cooperating one of said transverse grooves in the upper body portions, each of said conductive connecting pieces having a pointed thrusting blade at each of the opposite ends thereof to pierce and hold each respective wire end.

* * * * *